United States Patent [19]

Theurer et al.

[11] Patent Number: 4,566,389

[45] Date of Patent: Jan. 28, 1986

[54] MOBILE APPARATUS AND METHOD FOR RECEIVING AND TRANSPORTING AN ASSEMBLED TRACK SECTION

[75] Inventors: Josef Theurer, Vienna; Friedrich Oellerer, Linz, both of Austria

[73] Assignee: Franz Plasser Bahnbaumaschinen-Industriegesellschaft m.b.H., Vienna, Austria

[21] Appl. No.: 678,763

[22] Filed: Dec. 5, 1984

[30] Foreign Application Priority Data

Apr. 10, 1984 [AT] Austria ..... 1208/84

[51] Int. Cl.[4] ..... E01B 29/02

[52] U.S. Cl. ..... 104/3; 414/459

[58] Field of Search ..... 104/2–5, 104/7 B; 414/339, 342, 345, 459, 460

[56] References Cited

U.S. PATENT DOCUMENTS 4,270,456 6/1981 Theurer et al. ..... 104/3

FOREIGN PATENT DOCUMENTS 2104133 3/1983 United Kingdom ..... 104/3

*Primary Examiner*—Randolph A. Reese
*Assistant Examiner*—Dennis C. Rodgers
*Attorney, Agent, or Firm*—Kurt Kelman

[57] ABSTRACT

A mobile apparatus for replacing an assembled section of track in a track renewal section, the assembled track section consisting of rails fastened to ties defining spaces therebetween, comprises a succession of transport vehicles having undercarriages capable of running on the track for moving therealong, and hoists for gripping and carrying the assembled track section are mounted on the transport vehicles. An elongated overhead girder extends in a plane above the transport vehicles and has longitudinally extending sides defining therebetween a guide track for moving the succession of transport vehicles therealong, and drives move the vehicles along the guide track. A succession of vertically and laterally adjustable supports for the overhead girder are laterally adjustable to selected lateral positions spaced from the girder sides whereby a wide enough space extending transversely to the track is left to permit the free passage of an assembled track switch section carried by the transport vehicles moving along the girder, the supports including power drives for adjusting the supports.

16 Claims, 13 Drawing Figures

Fig. 5
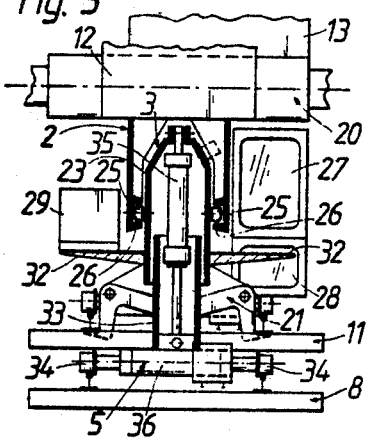
Fig. 6
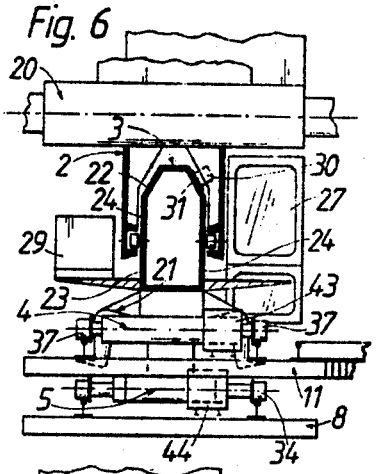
Fig. 9
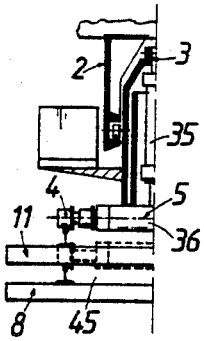
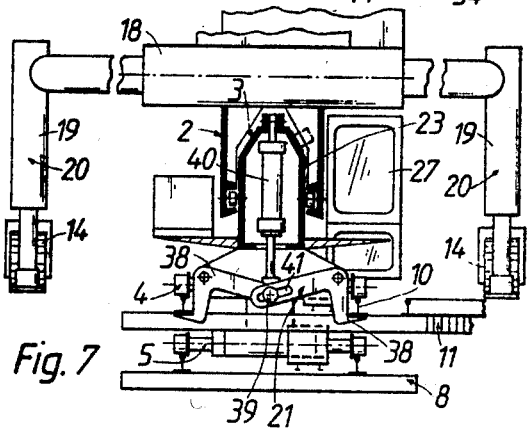
Fig. 7
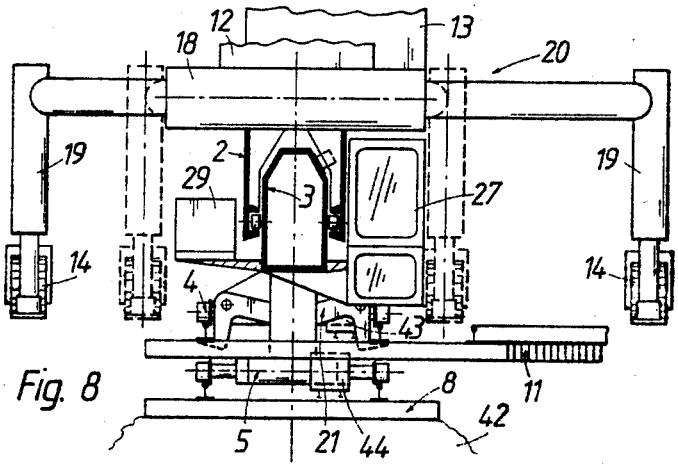
Fig. 8

MOBILE APPARATUS AND METHOD FOR RECEIVING AND TRANSPORTING AN ASSEMBLED TRACK SECTION

The present invention relates to a mobile apparatus for replacing an assembled section of track in a track renewal section, the assembled track section consisting of rails fastened to ties defining spaces therebetween. It also relates to a method for replacing an assembled track section with such a mobile apparatus.

U.S. Pat. No. 4,270,456, dated June 2, 1981, discloses such an apparatus which, in one embodiment, comprises a succession of transport vehicles, which are coupled together, and an elongated overhead girder extending in a plane over the transport vehicles and having longitudinally extending sides defining therebetween a guide track for moving the assembled track section therealong, the girder being equipped with a succession of supports vertically and laterally adjustable to selected lateral positions spaced from the girder sides whereby a wide enough space extending transversely to the track is left to permit the free passage of an assembled track switch section, the supports including power drives for adjusting the supports. One end of the overhead girder is mounted for pivoting about a vertical axis on one of the transport vehicles closest to the track renewal section where the assembled track section is to be, respectively, received or laid. As soon as this one transport vehicle has reached the renewal section, the overhead girder is pivoted by 180° from its rest position, in which it extends over the transport vehicles, to its working position above the renewal section where it is supported on the supports. A trolley carrying a hoist is then moved over the assembled track section, the hoist is lowered and the assembled track section is gripped and carried by the hoist. In another embodiment, the overhead girder has two carrier arms mounted on a transport vehicle for pivoting about vertical axes. One of the girder carrier arms extends over the transport vehicles while the other arm projects beyond the foremost transport vehicle. The free ends of the girder carrier arms are equipped with two laterally pivotal and vertically adjustable supports, and each arm has a through guide track for moving the hoist carrying the assembled track section therealong. To receive an assembled track section in a renewal section, the apparatus is moved by its transport vehicles over the assembled track section, the one girder carrier arm is supported on the transport vehicles and the other arm is supported on the ballast in the renewal section. The assembled track section is then hoisted and the trolley carrying the hoist is moved along the guide track to the rear end of the one girder carrier arm where it is deposited on a transport vehicle.

British patent application No. 2,104,133 A, published Mar. 2, 1983, discloses a mobile apparatus for receiving and laying an assembled track section. The apparatus comprises two gantries located at respective ends of the assembled track section and running on auxiliary rails, the two gantries being connected by adjusting drives to a central overhead girder. A laterally displaceable pair of gripping tongs is mounted at each end of the girder. In operation, this apparatus is moved along the auxiliary rails over the assembled track section, the girder is lowered and the gripping tongs are operated to grip the assembled track section and to lift it by raising the girder. The raised assembled track section is then moved to the track renewal section along the auxiliary rails and laid by lowering the girder. This apparatus requires auxiliary rails which interfere with train traffic.

It is the primary object of this invention to provide a mobile apparatus of the first indicated type and particularly useful in the handling of track switch sections, which is relatively simple in structure and provides a dependable but rapid operation.

The above and other objects are accomplished according to one aspect of the invention with a mobile apparatus which comprises a succession of transport vehicles having undercarriages capable of running on the track for moving therealong and vertically adjustable means for gripping and carrying the assembled track section on said transport vehicles. An elongated overhead girder extends in a plane above the transport vehicles and has longitudinally extending sides defining therebetween a guide track for moving the succession of transport vehicles, and drive means for moving the vehicles along the guide track. A succession of vertically and laterally adjustable supports for the overhead girder are laterally adjustable to selected lateral positions spaced from the girder sides whereby a wide enough space extending transversely to the track is left to permit the free passage of an assembled track switch section by the transport vehicles moving along the girder, the supports including power drives for adjusting the supports.

According to another aspect, the present invention provides a method of replacing an assembled track section with such a mobile apparatus, which comprises the steps of placing the assembled track section on the track, moving the mobile apparatus along the assembled track section with one of the undercarriages of the transport vehicles in rolling engagement with the track rails of the assembled track section, operating the gripping and carrying means to grip the assembled track section and to carry it on the transport vehicles, lowering the vertically adjustable undercarriage through respective ones of the spaces between the ties for rolling engagement with the rails of the track for moving the mobile apparatus to the renewal section, moving the overhead girder over the renewal section and supporting the girder thereon on end supports, moving the transport vehicles with the assembled track section gripped and carried thereby along the guide track of the overhead girder until the assembled track section is centered over the renewal section, operating the power drives to adjust the supports of the overhead girder and the gripping and carrying means until the assembled track section has been aligned with the track and laid on the renewal section, and raising the vertically adjustable undercarriage for rolling engagement of both undercarriages with the laid assembled track section and the track aligned therewith, disengaging the gripping and carrying means from the assembled track section, and returning the mobile apparatus therealong for receiving another one of the assembled track sections.

The mobile apparatus of this invention makes it possible for the first time to receive the assembled track section directly from the track along which the apparatus moves without the need for the use of auxiliary rails or lengthy refitting operations, and to move the assembled track section rapidly to and from a track renewal section. This apparatus can be used with great advantage for handling a track switch in a track section where there is no room on the shoulders for the placement of the track switch to be replaced. However, the mobile apparatus may also be used for moving an assembled track section to and from the shoulder at a track renewal section. The apparatus can be operated without any preparation, the track renewal section being simply bridged by extending the apparatus in alignment with the track over the renewal section. This enables the replacement to proceed rapidly and without any hindrance to train traffic over a neighboring track.

The method of the invention permits an assembled track section, which is placed on the track, to be moved rapidly and directly to a trackless renewal section where it is laid in alignment with the track, with a compact apparatus moving along the track without interfering with trains passing over the neighboring track.

The above and other objects, advantages and features of the present invention will become more apparent from the following detailed description of a now preferred embodiment thereof, taken in conjunction with the accompanying, partly schematic drawing wherein FIG. 1 is a side elevational view of a mobile apparatus for replacing an assembled track section;

FIGS. 5 to 8 are enlarged transverse cross sections along lines V—V, VI—VI, VII—VII and VIII—VIII, respectively, of FIG. 1;

FIG. 9 is an enlarged transverse cross section of a half of the mobile apparatus along line IX—IX of FIG. 3;

Figures 1, 2, 3, 4:
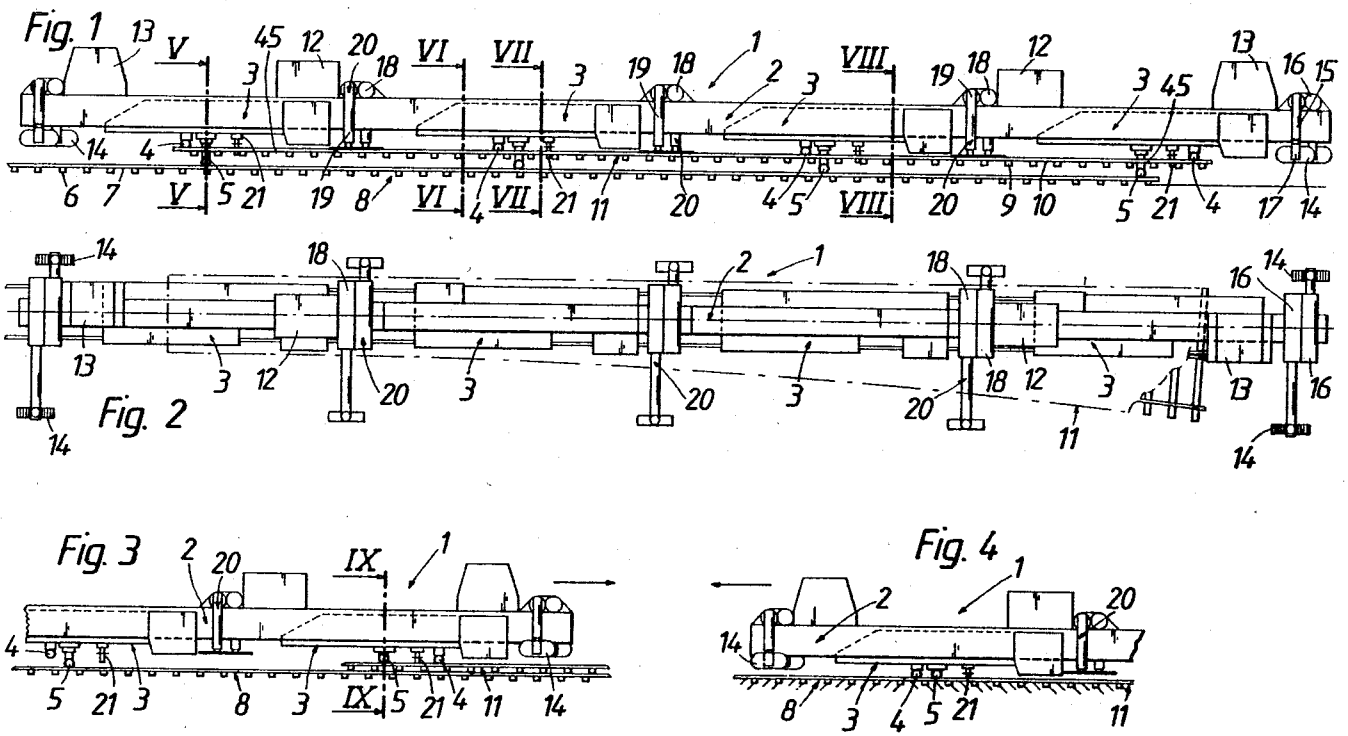
FIG. 2 is a top view of the mobile apparatus.
FIGS. 3 and 4 are fragmentary side elevational views of the mobile apparatus in different operating positions.

Referring now to the drawing and first to FIGS. 1 and 2, there is shown mobile apparatus 1 for replacing an assembled section of track 8 consisting of rails 7 fastened to ties 6 in a track renewal section. The assembled track section is shown as track switch 11 consisting of rails 10 fastened to ties 9 defining spaces 45 therebetween. Mobile apparatus 1 comprises a succession of four transport vehicles 3 which are coupled together and have undercarriages 4 capable of running on assembled track section 11 and undercarriage 5 capable of running on track 8 for moving therealong. Transport vehicles 3 are equipped with vertically adjustable means 21 for gripping and carrying assembled track section 11 thereon. Elongated overhead girder 2 extends in a plane above the transport vehicles and has longitudinally extending sides defining therebetween guide track 26 (see FIGS. 5 to 9) for moving the succession of transport vehicles 3 therealong, drive means 30 being provided for moving the vehicles along the guide track. A succession of vertically and laterally adjustable supports 20 for the overhead girder are laterally adjustable to selected lateral positions spaced from the girder sides whereby a wide enough space extending transversely to the track is left to permit the free passage of assembled track switch section 11 carried by the transport vehicles moving along the girder, the supports including power drives 18, 19 for adjusting the supports. Supports 20 are regularly spaced along overhead girder 2 and comprise vertically adjustable jacks operated by drives 19 and drives 18 mounted on the girder for laterally adjusting the jacks. The supports also include track-laying bogies 14 at respective ends of overhead girder 2 and power drives 15, 16 for vertically and laterally adjusting the support bogies. The bogies are self-propelled by drives 17. Power plants 12 and operator's cabs 13 are mounted at the respective overhead girder ends. The power drives may be hydraulically operated cylinder-piston motors. Track switch 11, which may be about 40 m long, is gripped and carried on transport vehicles 3 by means 21, and is shown in FIG. 2 in dash-dotted lines. As shown in the drawing, overhead girder 2 has a length exceeding that of all the transport vehicles and that of the assembled track section.

The excess length of the overhead girder makes it possible to keep it connected to one of the transport vehicles even after it has been extended over a track renewal section. Thus, even at a maximum extension of the mobile apparatus, the coupled unit of transport vehicles remains securely and stably connected with the girder. Furthermore, since the girder ends are supported on track-laying bogies, no torsion moment is transmitted to the transport vehicles when the overhead girder is moved over the renewal section on the bogies during the extension of the apparatus. The lateral adjustability of the track-laying support bogies will adapt these supports, too, to the width of the track switch being handled.

FIGS. 3 and 4 illustrate the front and rear ends of apparatus 1, respectively. The various operating positions of the mobile apparatus will be described in detail hereinafter in connection with the description of the method of this invention.

FIGS. 5 to 9 illustrate preferred structural details of mobile apparatus 1. As shown in these figures, each transport vehicle 3 is equipped with two undercarriages 4, 5 comprised of an axle with flanged wheels 37, 34 spaced apart a distance corresponding to the track gage for rolling engagement with the track rails. Undercarriage 5 is vertically adjustable and the axle of undercarriage 5 is laterally adjustable for reducing the distance between flanged wheels 34 to less than the track gage whereby undercarriage 5 may be lowered through a respective one of spaces 45 between the ties of assembled track section 11 carried by vehicles 3. The combination of two undercarriages and a means for gripping and carrying the assembled track section on the transport vehicles provides a simple arrangement enabling the mobile apparatus to be moved from the track wherealong it moves onto the assembled track section placed on the track without impairing the stability of the apparatus. No preparations at all are necessary, which ensures rapid working progress. The unit of coupled transport vehicles and the overhead girder of the mobile apparatus are telescopingly extensible with respect to each other to adapt the overall length of the apparatus to the length of the assembled track section being handled thereby and makes it possible to grip and carry it securely.

Each illustrated transport vehicle comprises frame 22 having two longitudinally extending sides 24 and operator's cab 27 laterally adjacent one frame side. The operator's cab is arranged for free passage in the wide space extending transversely to the track, which is provided by the lateral adjustment of supports 20. Guide rollers 25 are mounted on frame sides 24 for rolling engagement with guide track 26. Flanged wheels 34 of lowered undercarriage 5 are selectively in running engagement with track 8 or assembled track section 11 laid in the track renewal section while undercarriage 4, which is shown to be immovably affixed to the transport vehicle, is in running engagement with the assembled track section carried by transport vehicles 3.

Frame 22 consists of housing 23 having two longitudinally extending sides 24 and a bottom extending between the sides, the transport vehicle frame being of substantially U-shaped transverse cross section substantially closed at the bottom. Power drive 40 for vertically adjusting means 21 for gripping and carrying assembled track section 11 and another power drive 35 for vertically adjusting the one undercarriage 5 are housed in frame housing 23 and linked thereto centrally between longitudinally extending sides 24 thereof and project through the bottom thereof for linkage to means 21 for gripping and carrying the assembled track section and to undercarriage 5. Elongated overhead girder 2 and the longitudinally extending sides thereof also is of substantially U-shaped transverse cross section but is open at the bottom and at respective ends thereof, transport vehicle frame housing 23 being configurated for telescopic passage through the elongated overhead girder. The guide track is arranged at the lower ends of the two longitudinally extending sides of overhead girder 2 and guide rollers 25 are mounted on frame sides 24 for rolling engagement with guide track 26 for the telescopic passage of the transport vehicles through the U-shaped overhead girder. A platform 32 extends from each frame side 24 substantially coplanar with the bottom of the frame 22. A central control 28 is arranged in cab 27 and enables drive motor 29, which is mounted on the platform, to be actuated for operation of drive means 30 for moving the vehicle along guide track 26. The illustrated drive means is a pinion driven by drive motor 29 and meshing with rack 31. The driven pinion is mounted on overhead girder 2 and the rack is mounted on transport vehicle frame 22 and extends in the direction of guide track 26.

As shown in FIG. 5, the bottom of transport vehicle housing 23 defines an opening in alignment with undercarriage 5 and vertically displaceable guide part 33 is received in this opening. The guide part is affixed to the axle of the undercarriage. Vertical adjustment drive 35 extends through the guide part, its cylinder end being linked to the top of transport vehicle housing 23 while its piston rod end is linked to the undercarriage axle which is comprised of drive cylinder 36 transversely displaceably housing two piston rods to which flanged wheels 34 are affixed. This enables the gage of undercarriage 5 to be changed so that it may be reduced when the undercarriage is moved by power drive 35 through space 45 and then be re-adjusted again to the gage of the track.

Means 42 for gripping and carrying assembled track section 11 comprises a pair of bellcrank levers 38 operable by power drive 40 for engaging the gage sides of rails 10 of the assembled track section and for subtending these rails.

This centered arrangement of the power drives assures a great stability and prevents the apparatus from tipping over to one side or the other so that it may be used for replacing even very heavy track switches. The bellcrank lever arrangement securely grips and carries such track switches. The telescoping cooperation of the transport vehicles with the overhead girder holds the apparatus to a relatively small height while assuring a stable connection between the vehicles and the girder. Furthermore, transport vehicle housings of U-shaped cross section provide stable and rigid carriers for the heavy track sections so that they constitute a robust working unit capable of carrying heavy loads even when they are moved out of the U-shaped girder. Cooperating guide rollers 25 and guide track 26 provide a simple and robust track for vehicles 3 which permits ready and fast detachment of the vehicles from the girder and movement of the vehicles into and along the girder.

Figures 10, 11, 12, 13:
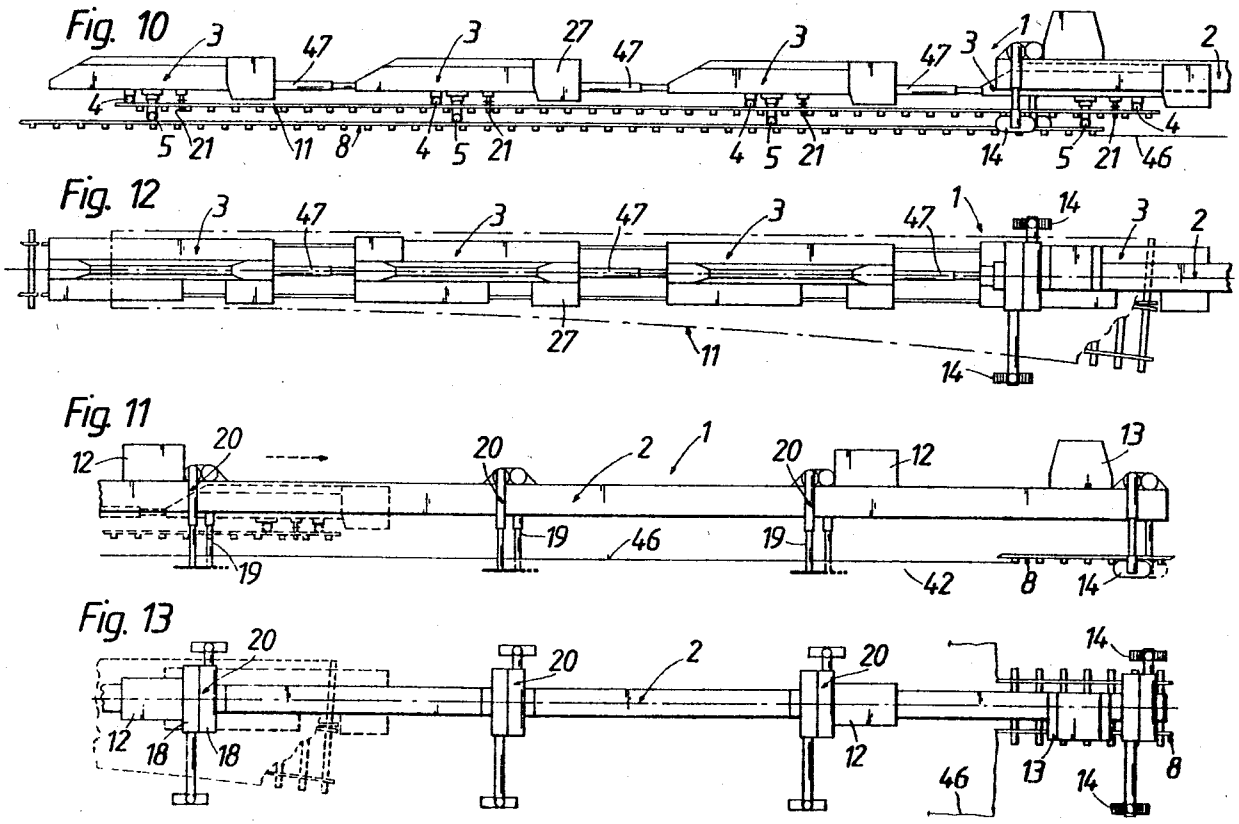
FIGS. 10 and 11 are side elevational views of the mobile apparatus, respectively showing the transport vehicles thereof in their extended positions and the overhead girder supported adjacent thereto over a track renewal section.
FIGS. 12 and 13 are top views of the mobile apparatus in this operating position.

As shown in FIG. 10, coupling means 47 between the transport vehicles are adjustable in length whereby the distance between successive vehicles may be changed. An adjustment of the coupling means enables the apparatus to be adapted to the length of the assembled track section being handled, the provision of four such vehicles assuring a secure transportation even of a relatively long and heavy track switch. The total length of the coupled vehicles is such that undercarriage 5 of any selected vehicle may be lowered freely through spaces 45 between ties 9 at the ends of assembled track section 11. This assures optimal use of mobile apparatus 1 and its unit of coupled transport vehicles 3, with the assembled track section being gripped at its respective ends without subjecting it to flexing stresses.

Flanged wheels 34 of vertically adjustable undercarriage 5 have a diameter smaller than the width of spaces 45 between the ties and than the height of the ties. This will enable the undercarriage to be freely moved through spaces 45 of an assembled track section placed on the track, as shown in FIG. 1, to bring flanged wheels 34 into rolling engagement with underlaying track 8 without requiring the assembled track section to be moved.

As best shown in FIG. 6, the axle of undercarriage 4 is rigidly mounted on the bottom of transport vehicle housing 23 and its flanged wheels 37 are in rolling engagement with the rails of the assembled track section placed on track 8 as mobile apparatus 1 moves along the track over assembled track section 11 (see FIG. 1). Bellcrank levers 38 have hooks at their outer ends for subtending engagement with rails 10 of the assembled track section (see particularly FIG. 7). The inner end of one bellcrank levers is affixed to bolt 39 at the outer end of the piston rod of power drive 40 which extends through vehicle housing 23 and whose cylinder end is connected to the top of the vehicle housing. The inner end of the other bellcrank lever defines elongated slot 41 displaceably engaged by bolt 39. When vertical adjustment drive 40 is actuated, the hook-shaped ends of bellcrank levers 38 will be pivoted into and out of engagement with the base of rails 10.

FIG. 8 illustrates the lateral displacement of girder supports 20 and 14 for the unhindered passage of track switch 11 whose configuration on one side requires a wide space alongside track 8 to permit the passage of the track switch by transport vehicles 3 moving along girder 2. For moving the supports from their retracted rest position (shown in broken lines) to the extended support position, power drives 16, 18 are actuated at the same time as jacks 15 and 19 for lowering the supports until they rest on the ground.

Transport vehicles 3 may be self-propelled by drives 43, 44 on their undercarriages.

In the position illustrated in FIGS. 3 and 9, assembled track section 11 rests on track 8 and, while undercarriage 4 of the foremost transport vehicle of approaching mobile apparatus 1 is already in rolling engagement with the assembled track section, undercarriages 5 of the succeeding transport vehicles are in rolling engagement with track 8. Successive undercarriages 5 are then retracted to the plane of assembled track section 11, their track gage is reduced by operation of drive 36 and they are lowered by operation of drive 35 through spaces 45 to come into rolling engagement with track 8 underlying the assembled track section.

FIGS. 10 to 13 schematically illustrate the method of this invention, as practiced with mobile apparatus 1, showing the operating phase wherein overhead girder 1 has been extended over track renewal section 46 while transport vehicles 3 are supported by lowered undercarriages 5 on track 8 adjacent the track renewal section. The transport vehicles are coupled together by longitudinally adjustable cylinder-piston couplings. The operation proceeds as follows:

As shown in FIG. 3, assembled track section 11 is placed on track 8 and mobile apparatus 1 is moved along track 8 towards the assembled track section, with transport vehicles 3 stored in succession on guide track 26 of overhead girder 2, while end supports 14 of the girder are retracted and vertically adjustable undercarriages 5 of transport vehicles 3 are lowered into rolling engagement with track 8. In this initial operating phase, motors 44 are actuated to propel apparatus 1 along the track on undercarriages 5 in the direction of the arrow shown in FIG. 3. As mobile apparatus 1 reaches assembled track section 11 on track 8, undercarriage 4 of the foremost transport vehicle comes into rolling engagement with the assembled track section for support thereon. Undercarriage 5 is then raised to a level slightly above rails 10 of assembled track section 11 and successive undercarriages 5 are similarly raised while successive undercarriages 4 come into rolling engagement with assembled track section 11 as mobile apparatus 1 is moved further along track 8 over the assembled track section, as shown in FIG. 1. Lateral adjustment drives 16, 18 are now operated to adjust supports 20 and 14 to lateral positions spaced from the girder sides whereby a wide enough space extending transversely to track 8 is left to permit the free passage of track switch 11 by transport vehicles 3 moving along the girder. At the same time, drives 36 are operated to reduce the track gage of undercarriages 5 to enable them to be lowered between rails 10 through spaces 45 between ties 9 of the track switch (see FIG. 9). If the axle of any undercarriage 5 should be located above a tie 9 of the track switch and the undercarriage, therefore, cannot be lowered through adjacent space 45, motor 43 of adjacent undercarriage 4 is actuated to move the vehicle sufficiently to bring the axle into registry with space 45 so that undercarriage 5 may be lowered therethrough. Drive 36 is then actuated again to increase the track gage of lowered undercarriage 5 until its flanged wheels 34 are in rolling engagement with rails 7 of track 8. At the same time, power drives 40 are operated to pivot bellcrank levers 38 of gripping and carrying means 21 to grip assembled track section 11 and to carry it on transport vehicles 3. Power drives 35 are operated to lower undercarriages 5 until mobile apparatus 1 and track switch 11 gripped and carried thereby are lifted off track 8 (see FIG. 1). Track-laying bogies 14 of the front end support of overhead girder 2 are then lowered into engagement with trackless renewal section 46 by actuating vertical adjustment drives 15 and drives 17 of the track-laying bogies are actuated to move the girder along and over the renewal section while supporting the girder thereon on the supports (FIGS. 10, 11). Transport vehicles 3 carrying track switch 11 remain in position on track 8 adjacent renewal section 46 while overhead girder 2 is extended thereover. During this relative movement, guide rollers 25 of transport vehicles 3 roll along guide track 26 of girder 2 to enable the girder to be pulled out of the unit of coupled transport vehicles.

As shown in FIGS. 11 and 13, the overhead girder is moved over renewal section 46 until front supports 14 of the girder have been moved into the range of track 8 at the remote end of the renewal section. Vertical adjustment drives 19 are operated until the pads of jacks 20 come to rest on ballast bed 42 in the renewal section, thus securely supporting overhead girder 2 along its entire length.

Rack-and-pinion drives 30, 31 are now actuated by motors 29 to move transport vehicles 3 with assembled track section 11 gripped and carried thereby along guide track 26 of overhead girder 2 until the assembled track section is centered over renewal section 46. As soon as successive undercarriages 5 reach the renewal section, drives 35 and 36 are operated to raise the undercarriages through respective spaces 45 between the ties of track switch 11 until flanged wheels 34 of these undercarriages are in a plane for rolling engagement with rails 10 of the track switch. After the track switch has been centered over renewal section 46, power drives 15, 19 are operated until apparatus 1 has been lowered sufficiently to lay track switch 11 on ballast bed 42. Power drives 16, 18 are then operated to adjust the supports 14, 20 of the overhead girder and gripping and carrying means 21 until the track switch has been aligned with track 8 and laid on the renewal section. Drives 40 are then operated to disengage bellcrank levers 38 of gripping and carrying means 21 from assembled track section 11, and supports 14, 20 are retracted into a rest position (shown in broken lines in FIG. 8) by operation of power drives 15, 16 and 18, 19. Undercarriages 5 have been raised for rolling engagement of both undercarriages 4 and 5 with the laid assembled track section and the track aligned therewith so that mobile apparatus 1 may be returned therealong for receiving another one of the assembled track sections, as indicated by the arrow in FIG. 4. Obviously, the above-described operational steps may be reversed to receive and transport an old assembled track section from a renewal section.

As will be appreciated from the above description, this method permits simple and rapid replacement of an assembled track section with a compact apparatus and without the use of any auxiliary equipment, which assures a speedy operation. At the same time, the replacement operation will not interfere with train traffic over a neighboring track. The operating phases proceed without interruption and the alternating use of the two undercarriages on each transport vehicle in certain phases of the operation assure a stable support of the apparatus in all phases.

Finally, mobile apparatus 1 may also be used for depositing an old assembled track section laterally adjacent a track renewal section over which the apparatus has been moved and picking up a new assembled track section to lay it in the renewal section, simply by laterally moving the apparatus off the track with the old assembled track section and returning it thereto with the new assembled track section. For this purpose, lateral adjustment power drives 16, 18 of girder supports 14, 20 are operated in opposite directions while the supports support the girder on ballast bed 42 for displacing apparatus 1 laterally by moving the supports which have been extended from one side of the girder towards the one girder side while the opposite supports which have been retracted are moved away from the opposite side of the girder while the supports support the girder, into which the transport vehicles have been telescoped, like stilts. In this manner, an assembled track section may be replaced by the lateral displacement of the apparatus. The track may then be used for train traffic immediately after the new assembled track section has been laid while the old assembled track section deposited on the shoulder of the track may be moved away or dismantled at a later time.

It will be understood that the described and illustrated structural features constitute only one specific example and that the described methods are only preferred ways of operating the apparatus. For example, undercarriages 4, 5 need not equipped with their own drives 43, 44 and the train of transport vehicles may be moved by a small locomotive or any other self-propelled vehicle. The scope of the invention is defined by the appended claims.

What we claim is:

1. A mobile apparatus for replacing an assembled section of track in a track renewal section, the assembled track section consisting of rails fastened to ties defining spaces therebetween, which comprises (a) a succession of transport vehicles having undercarriages capable of running on the track for moving therealong, (b) vertically adjustable means for gripping and carrying the assembled track section on said transport vehicles, (c) an elongated overhead girder extending in a plane above the transport vehicles and having longitudinally extending sides defining therebetween a guide track for moving the succession of transport vehicles therealong, (d) drive means for moving the vehicles along the guide track, and (e) a succession of vertically and laterally adjustable supports for the overhead girder, the supports being laterally adjustable to selected lateral positions spaced from the girder sides whereby a wide enough space extending transversely to the track is left to permit the free passage of an assembled track switch section carried by the transport vehicles moving along the girder, the supports including (1) power drives for adjusting the supports.

2. The mobile apparatus of claim 1, further comprising means for coupling at least two of said transport vehicles together.

3. The mobile apparatus of claim 2, comprising four of said transport vehicles, the coupling means being adjustable in length whereby the distance between successive ones of the vehicles may be changed.

4. The mobile apparatus of claim 2, wherein each one of said transport vehicles is equipped with two of said undercarriages comprised of an axle with flanged wheels spaced apart a distance corresponding to the track gage for rolling engagement with the track rails, one of the undercarriages being vertically adjustable and the axle of the one undercarriage being laterally adjustable for reducing the distance between the flanged wheels to less than the track gage whereby the one undercarriage may be lowered through a respective one of the spaces between the ties of the assembled track section carried by the vehicles.

5. The mobile apparatus of claim 4, wherein each transport vehicle comprises a frame having two longitudinally extending sides, an operator's cab laterally adjacent one of the frame sides and arranged for free passage in the wide space extending transversely to the track, and guide rollers mounted on the frame sides for rolling engagement with the guide track, the flanged wheels of the lowered undercarriage being selectively in running engagement with the track or the assembled track section laid in the track renewal section while the other undercarriage is in running engagement with the assembled track section carried by the transport vehicles.

6. The mobile apparatus of claim 5, further comprising a power drive for vertically adjusting the means for gripping and carrying the assembled track section and another power drive for vertically adjusting the one undercarriage, the power drives being linked to the frame of the transport vehicle centrally between the longitudinally extending sides thereof.

7. The mobile apparatus of claim 6, wherein the means for gripping and carrying the assembled track section comprises a pair of bellcrank levers operable by the other power drive for engaging the gage sides of the track rails and for subtending the track rails.

8. The mobile apparatus of claim 4, wherein each transport vehicle comprises a frame consisting of a housing having two longitudinally extending sides and a bottom extending between the sides, the transport vehicle frame being of substantially U-shaped transverse cross section substantially closed at the bottom, a power drive for vertically adjusting the means for gripping and carrying the assembled track section and another power drive for vertically adjusting the one undercarriage, the power drives being housed in the frame housing, linked thereto centrally between the longitudinally extending sides thereof and projecting through the bottom thereof for linkage to the means for gripping and carrying the assembled track section and to the one undercarriage, and the elongated overhead girder and the longitudinally extending sides thereof being of substantially U-shaped transverse cross section open at the bottom and at respective ends thereof, the transport vehicle frame being configurated for telescopic passage through the elongated overhead girder.

9. The mobile apparatus of claim 8, wherein the guide track is arranged at the lower ends of the two longitudinally extending sides of the overhead girder and the guide rollers are mounted on the frame sides for rolling engagement with the guide track for said passage.

10. The mobile apparatus of claim 9, further comprising a platform extending from each frame side and substantially coplanar with the bottom of the frame.

11. The mobile apparatus of claim 4, wherein the flanged wheels of the vertically adjustable undercarriage have a diameter smaller than the width of the spaces between the ties and than the height of the ties.

12. The mobile apparatus of claim 4, wherein the total length of the coupled vehicles is such that the one undercarriage of selected ones of the vehicles may be lowered freely through the spaces between the ties at the ends of the assembled track section.

13. The mobile apparatus of claim 1, wherein the overhead girder has a length exceeding that of the assembled track section and that of all the transport vehicles, and the supports include supports at respective ends of the overhead girder, the end supports including self-propelled track-laying bogies.

14. A method of replacing an assembled section of track consisting of rails fastened to ties defining spaces therebetween in a track renewal section in alignment with a track, with a mobile apparatus comprising a succession of transport vehicles being equipped with two undercarriages and vertically adjustable means for gripping and carrying the assembled track section, one of the undercarriages being vertically adjustable whereby the one undercarriage may be lowered through a respective one of the spaces between the ties of the assembled track section, an elongated overhead girder extending in a plane above the transport vehicles and having longitudinally extending sides defining therebetween a guide track for moving the succession of transport vehicles therealong, the overhead girder having a length exceeding that of the assembled track section to be transported and that of all the transport vehicles, drive means for moving the vehicles along the guide track, and a succession of vertically and laterally adjustable supports for the overhead girder including supports at respective ends of the overhead girder, the supports being laterally adjustable to selected lateral positions spaced from the girder sides whereby a wide enough space extending transversely to the track is left to permit the free passage of an assembled track switch section by the transport vehicles moving along the girder, and each end support including a self-propelled track-laying bogie, the supports including power drives for adjusting the supports and the gripping and carrying means, which method comprises the steps of (a) placing an assembled track section on the track, (b) moving the mobile apparatus along the assembled track section with one of the undercarriages of the transport vehicles in rolling engagement with the track rails of the assembled track section, (c) operating the gripping and carrying means to grip the assembled track section and to carry it on the transport vehicles, (d) lowering the vertically adjustable undercarriages through respective ones of the spaces between the ties for rolling engagement with the rails of the track for moving the transport vehicles to the renewal section, (e) moving the overhead girder over the renewal section and supporting the girder thereon on the end supports, (f) moving the transport vehicles with the assembled track section gripped and carried thereby along the guide track of the overhead girder until the assembled track section is centered over the renewal section, (g) operating the power drives to adjust the supports of the overhead girder and the gripping and carrying means until the assembled track section has been aligned with the track and laid on the renewal section, and (h) retracting the vertically adjustable undercarriage for rolling engagement of both undercarriages with the laid assembled track section and the track aligned therewith, disengaging the gripping and carrying means from the assembled track section, and returning the mobile apparatus therealong for receiving another one of the assembled track sections.

15. The method of claim 14, comprising the further steps of (a) moving the mobile apparatus along the track to the assembled track section placed thereon, with the transport vehicles stored in succession on the guide track of the overhead girder, while the end supports of the girder are retracted and the vertically adjustable undercarriages of the transport vehicles are lowered into rolling engagement with the track, (b) raising successive ones of the lowered undercarriages while successive ones of the other undercarriages of the transport vehicles come into rolling engagement with the assembled track section as the mobile apparatus is moved further along the track over the assembled track section, the vertically adjustable undercarriages being lowered and the gripping and carrying means being operated until the mobile apparatus and the assembled track section gripped and carried thereby are lifted off the track, (c) lowering the track-laying bogie of a front one of the end supports into engagement with the renewal section to move the overhead girder therealong and over it, and operating the power drives to adjust the succession of supports for support of the overhead girder on the renewal section while providing a wide enough space extending transversely to the track to permit the free passage of the assembled track switch section, (d) raising the vertically adjustable undercarriages in succession as they reach the renewal section while the transport vehicles are moved with the assembled track section gripped and carried thereby along the guide track of the overhead girder until the assembled track section is centered over the renewal section, and (e) retracting the supports into a rest position before the mobile apparatus is returned.

16. A method of replacing an assembled section of track consisting of rails fastened to ties in a track renewal section in alignment with a track, with a mobile apparatus comprising a succession of transport vehicles being equipped with two undercarriages and vertically adjustable means for gripping and carrying the assembled track section, one of the undercarriages being vertically adjustable, an elongated overhead girder extending in a plane above the transport vehicles and having longitudinally extending sides defining therebetween a guide track for moving the succession of transport vehicles therealong, the overhead girder having a length exceeding that of the assembled track section to be transported and that of all the transport vehicles, drive means for moving the vehicles along the guide track, and a succession of vertically and laterally adjustable supports for the overhead girder including supports at respective ends of the overhead girder, the supports being laterally adjustable to selected lateral positions spaced from the girder sides whereby a wide enough space extending transversely to the track is left to permit the free passage of an assembled track switch section by the transport vehicles moving along the girder, and each end support including a self-propelled track-laying bogie, the supports including power drives for adjusting the supports and the gripping and carrying means, which method comprises the steps of (a) moving the mobile apparatus along the track and the assembled track section in the renewal section with at least one of the undercarriages of the transport vehicles in rolling engagement with the track rails of the assembled track section until the mobile apparatus is centered over the renewal section, (b) supporting the overhead girder on the supports, (c) operating the gripping and carrying means to grip and carry the assembled track section on the transport vehicles in the renewal section, and (d) operating the power drives of the girder supports for displacing the mobile apparatus laterally by moving the supports which have been extended from one side of the girder towards the one girder side while the opposite supports which have been retracted are moved away from the opposite side of the girder.

* * * * *